US006659729B2

(12) United States Patent
Hattori et al.

(10) Patent No.: US 6,659,729 B2
(45) Date of Patent: Dec. 9, 2003

(54) SCREW COMPRESSOR EQUIPMENT FOR ACCOMMODATING LOW COMPRESSION RATIO AND PRESSURE VARIATION AND THE OPERATION METHOD THEREOF

(75) Inventors: Toshiro Hattori, Tokyo (JP); Katsuyuki Takahashi, Tokyo (JP); Kiyoshi Tanaka, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/783,133

(22) Filed: Feb. 15, 2001

(65) Prior Publication Data

US 2003/0007873 A1 Jan. 9, 2003

(51) Int. Cl.[7] ..... F04B 49/00
(52) U.S. Cl. ..... 417/53; 417/282
(58) Field of Search ..... 417/53, 12, 282, 417/299; 418/1; 60/39, 281; 62/117

(56) References Cited

U.S. PATENT DOCUMENTS 4,149,827 A * 4/1979 Hofmann, Jr. ..... 417/12
RE30,499 E * 2/1981 Moody, Jr. et al. ..... 62/117
4,544,333 A * 10/1985 Hirano ..... 417/299
4,548,549 A * 10/1985 Murphy et al. ..... 417/53
4,609,329 A * 9/1986 Pillis et al. ..... 417/282
4,812,110 A * 3/1989 Kubo et al. ..... 418/1
5,606,853 A * 3/1997 Birch et al. ..... 60/39.281

FOREIGN PATENT DOCUMENTS

DE 222989 A1 * 5/1987 ..... F02B/33/36

* cited by examiner

*Primary Examiner*—Teresa Walberg
*Assistant Examiner*—L Fastovsky
(74) *Attorney, Agent, or Firm*—Crowell & Moring LLP

(57) ABSTRACT

The invention provides a method of operating a screw compressor equipment without reducing the efficiency, in which a screw compressor 1 of which the internal volume ratio is variable by means of an internal volume ratio control valve is driven by a driving machine 2, the discharge side of the compressor 1 is communicated with the suction side of the same by way of a bypass control valve 9 as needed, the internal volume ratio control valve 3 is always controlled to be located at a position calculated so that the internal volume ratio with which the polytropic efficiency is maximum is obtained, and gas flow rate is controlled by controlling the rotation speed under normal conditions and controlled by controlling the bypassing flow rate from the discharge side to the suction side under very low rotation speed.

11 Claims, 8 Drawing Sheets

SCREW COMPRESSOR EQUIPMENT FOR ACCOMMODATING LOW COMPRESSION RATIO AND PRESSURE VARIATION AND THE OPERATION METHOD THEREOF

BACKGROUND OF THE INVENTION

1. Field of the Invention

The present invention relates to a screw compressor for accommodating low pressure ratios and pressure variation and the operating method thereof in the case where the screw compressor is applied in a use for compressing gas of relatively high pressure to a constant discharge pressure or for compressing gas of which suction pressure varies from low to near discharge pressure to a constant discharge pressure, that is, in a use in which discharge pressure is constant and suction pressure varies but compression ratio is not large as in the case of a gas fuel compressor of gas turbine booster or a compressor for pressure feeding natural gas; and in the case where the screw compressor is applied in a use for pressure feeding gas to a container of large volume as in the case of pressure feeding gas to a spherical holder of city gas etc., that is, in a use in which discharge pressure varies from near inlet pressure to a predetermined discharge pressure.

2. Description of the Related Art

Variable displacement screw compressors have been used for refrigerators. In the case of a refrigerator, inlet pressure is determined according to the kind of refrigerant and the temperature at which the refrigerant is evaporated at the evaporator. That is, the inlet pressure is kept constant in accordance with the kind of use of the refrigerator but the pressure at the high pressure side of the refrigerating cycle varies according to the temperature and cooling ability of the cooling medium such as cooling water or cooling air which cools the compressed refrigerant gas to condense it at the condenser. Generally, for refrigerator a screw compressor of suitable designed-in internal volume ratio (built-in pressure ratio) is selected from among compressors of low, medium, and high built-in pressure ratio according to the conditions of operation. So, a compressor with a determined internal volume ratio must cope with a certain range of operation conditions, and the polytropic efficiency is maximum at a certain operation condition but decreases at another operation conditions.

There is a type of screw compressor of which the internal volume ratio is controlled automatically from low to high internal volume ratio in accordance with operation conditions. As such a screw compressor is generally provided with a capacity control mechanism, its construction is complicated, the control of the internal volume ratio is difficult, and high polytropic efficiency is difficult to be obtained.

In a screw compressor, the compression pressure $P_2$ in the groove space enclosed between meshing teeth, i.e. the pressure in the groove space enclosed between meshing teeth just before it is communicated with the discharge port is related with the inlet pressure $P_s$ and the designed-in internal volume ratio $V_i$ as shown in the following equation:

$$P_2=P_s\times V_i^m$$

where m is polytropic exponent.

When the difference between said pressure $P_2$ and the discharge pressure $P_d$ of the screw compressor, i.e. the pressure at high pressure side of the refrigerating cycle is large, which means excessive or deficient compression, useless work is done, which reduces the polytropic efficiency. Therefore, the designed-in internal volume ratio of the compressor is selected or adjusted or controlled so that said pressure difference is within proper value.

FIG. 8 is a diagrammatic sketch for explaining the compression process of a screw compressor of general use in a refrigerator. In the figure, as a male rotor 12 and a female rotor(not shown) meshing with the male rotor 12 rotate, gas is sucked from an inlet port 15 into the groove space formed by the meshing tooth faces of the both rotors and the inner peripheral wall of a rotor casing 14. The volume of the groove space increases as the rotors rotate, for the meshing line of the tooth faces moves toward the discharge side. When said volume becomes maximum, the communication of the groove space with the inlet port is shut, the groove space becomes enclosed, and the sucked gas is enclosed in the groove space.

As the rotors further rotate, the inlet suction side meshing line of tooth faces moves toward the discharge side to reduce the volume of the enclosed groove space to compress the gas therein. When the tooth tip 12*b* (in FIG. 8, only the tooth tip 12*b* of the male rotor is shown) reaches the beginning edge 17*c* of the cut-off part 17*b* at the discharge side end of a slide valve 17 (actually the beginning edge 17*c* is a beginning edge line parallel to the tooth tip 12*b*), the enclosed groove space communicates with a discharge port 16, and the gas in the groove space is discharged as the rotors rotate. The internal volume ratio is the ratio of the maximum enclosed groove space volume versus the volume of the enclosed space volume just before the beginning of discharge.

The capacity control for varying the flow rate of gas through the screw compressor is effected by sliding the slide valve 17 which straddles the perimeters of the male rotor 12 and the female rotor(not shown) forming a part of the internal wall surface of the rotor casing 14 and is capable of being moved in the longitudinal direction of the rotors in a way it can not be moved further to the inlet side than the slide valve stopping face 19. When the slide valve 17 is moved so that its right end 17*a* comes to the location shown by a chain double dashed line 17*a'*, a gap develops between the right end 17*a* and the stopping face 19. As a result, the groove space is communicated with the inlet port 15 by way of a passage not shown communicating with the inlet port 15. The beginning of compression which is when the groove space becomes enclosed by the shutoff of communication between the groove space and the inlet port 15, becomes controlled by the right end 17*a*' of the slide valve 17.

Therefore, the farther the slide valve is moved to the left, the smaller the volume of groove space enclosed (hereafter referred to as the suction volume) and the flow rate of gas decreases.

As the beginning edge 17*c* of the cut-off part 17*b* at the discharge side end of a slide valve 17 moves to the left with the slide valve 17, the timing the enclosed groove space communicates with the discharge port is retarded and the volume of the enclosed groove space just before it communicates with the discharge port (hereafter referred to as the discharge volume) becomes smaller than when full load, i.e. when the right end 17*a* of the slide valve 17 is contacting with the stopping wall 19. As this decrease of the discharge volume is smaller than the decrease of the suction volume just after the slide valve 17 is moved to the left to depart from the stopping wall 19, the internal volume ratio is varied. When the slide valve 17 is moved to the left by some extent, the discharge volume which is the volume of enclosed groove space just before it begins to communicate with the axial port formed on the end face of the bearing case 14*a* facing the discharge side end face of rotors before the cutout part of the slide valve 17 begins to communicates with the discharge port varies with about the same rate as the suction volume, and the internal volume ratio does not vary much by controlling capacity.

Recently, as the reliability and durability of a screw compressor is superior than that of a compressor of other type, a screw compressor is required which is able to be used in the field in which a reciprocating compressor or centrifugal blower such as compressor for pressure feeding city gas to a gas turbine, compressor for boosting up the natural gas, etc. has been used.

When a compressor is used for pressure feeding city gas to a gas turbine or for boosting up the natural gas, there may be the case the discharge pressure is constant and the inlet pressure is relatively high or changes largely during operation according to use.

For example, in the case the discharge pressure is 1.8 MpaA and the inlet pressure is 0.8~1.6 MpaA, pressure ratio changes between 2.25~1.13, and assuming polytropic exponent of m=1.3, then required internal volume ratio for the best efficiency changes between 1.9~1.1. These values for internal volume ratio are largely small compared with those adopted in the case of a refrigerator. To attain pressure ratios as low as these values by a screw compressor, the designed-in volume ratio of the screw compressor must be small, that is, the dimension L in FIG. 8 must be small. But when the designed-in volume ratio of a screw compressor of variable capacity having a slide valve is too small, the suction groove space is communicated with the discharge groove space when the gas flow rate is decreased, and enclosed groove space can not be formed, leading to very low volumetric and polytropic efficiency.

The case the dimension L is small is shown in FIG. 9. In FIG. 9(*a*) showing the state at full load, the enclosed groove space 21 is formed as a result of the shutoff of communication of the groove space to the inlet port when the volume of the groove space is at its maximum. As the rotors rotate, the enclosed groove space 21 moves toward the discharge side while decreasing the volume, and when it reaches the beginning edge line 17*c* of the cut-off part 17*b* of the slide valve 17 and communicates with the discharge port 16, the discharging of the enclosed gas begins.

When the slide valve 17 is moved to the left to reduce the flow rate as shown in FIG. 9(*b*), enclosed groove space can not geometrically be formed, and the groove space 21' communicates with the discharge side at the same time with the inlet side as shown by the arrow to effect no compression of gas or even if slight compression is possible the volumetric efficiency is very small.

When gas of inlet pressure of 0.8~1.6 is compressed using a screw compressor of the designed-in volume ratio $V_i$=2.63 for conventional refrigerator use, the pressure $P_2$ of the enclosed groove space just before it communicates with the discharge port becomes, assuming polytropic efficiency of m=1.3, 2.8~5.6 MpaA, which is far higher than the required discharge pressure $P_d$ of 1.8 MpaA. In this case the load by the gas pressure in the radial and axial direction of the rotors is large, and the damage of the radial and thrust bearings for supporting the load is resulted or the life of them is shortened. Also, in this case, as the difference of pressure between the discharge port and enclosed groove space just before it communicates with the discharge port is large, larger vibration and noise are resulted leading to mechanical problems. For this reason, it has been usual that the inlet pressure is lowered to that commensurate to the designed-in internal volume ratio of the screw compressor. But in this case, as the density of inlet gas is decreased, the capacity of the compressor is to be increased to secure the same flow rate as that when the inlet pressure is not lowered, leading to increased initial cost, running cost, and decreased energy efficiency.

Inventions concerning the optimization of internal volume ratio are disclosed in the past in Unexamined Published Patent Application No. 5-033789, No. 6-323269, and 2000-283071. In these inventions, as the optimization is intended with the function of controlling capacity combined, there is a limit of the optimization all over the capacity control range, and they are different from the present invention in purpose.

SUMMARY OF THE INVENTION

The present invention is made in the light of the problems cited above. The object of the invention is to provide a screw compressor capable of accommodating low compression and large pressure variation, that is, capable of being operated with high efficiency in such a condition of use.

To solve the aforementioned problems, the present invention proposes a screw compressor equipment for accommodating low pressure ratio and pressure variation characterized in that a screw compressor of variable internal volume ratio controlled by an internal volume ratio control valve is driven by a driving machine of variable rotation speed, the discharge side of the compressor is connected with the suction side of the same by the medium of a bypass control valve as needed, a computing device for calculating polytropic exponent according to the kind of gas, discharge pressure, suction pressure, discharge temperature, suction temperature, etc. is provided, and a control part for controlling the internal volume ratio control valve according to the internal volume ratio determined by the computing device.

The screw compressor is a one having an inlet and outlet port on each end side, which compresses the sucked fluid through the change of the volume formed by the meshing of a male rotor and a female rotor mounted in a casing; wherein an internal volume ratio control valve having a part for forming a part of the inner peripheral wall of the casing, straddling the both rotors and facing the outer surface of the teeth of the both rotors with a minute gap is provided movable parallel to the axes of the rotors, the control valve being movable by an extended control shaft; the suction side end of the control valve does not enter into the rotor casing side, that is, the said end is apart from or level with the suction side end of the rotors, the control valve having a cut-off part on its discharge side end part for controlling the internal volume ratio from 1.0 to a low internal volume ratio by controlling the timing of the communication of the enclosed groove space with the discharge port by moving the control valve along the axes of the rotors.

To control the capacity of a screw compressor with a reduced designed-in internal volume ratio to lower than a certain degree is, as explained before, difficult due to geometrical constraints. So, in the present invention, a slide valve for controlling capacity is not provided, instead an internal volume ratio control valve is provided, and the flow rate is controlled by controlling the rotation speed of the screw compressor. In the case the discharge pressure is constant with varying suction pressure or in the case the suction pressure is constant with varying discharge pressure, in which accordingly the compression ratio varies, the internal volume ratio is controlled so that the polytropic efficiency is maximum by moving the internal volume ratio control valve according to the value determined by the computing device which calculates the polytropic exponent in accordance with the kind of gas, discharge and suction pressure and temperature, etc.

Further, by starting the compressor with the internal volume ratio adjusted to low values near 1.0, the starting torque is reduced to evade a state of impossibility of starting and the load to the driving motor and bearings are alleviated.

In the case radial bearings of the rotors of a screw compressor is sleeve bearings, it is preferable not to operate continuously under low rotation speed below a certain speed because long-operation under low rotation speed induces the wear and burn-out of bearings as the generation of oil film is difficult due to the low peripheral speed of bearings. Instead, it is preferable to reduce the discharge gas flow rate by controlling the flow rate of the bypass gas from the discharge side to the suction side by the bypass control valve provided on the passage connecting the discharge side with the suction side.

In the case the suction and discharge pressure is constant, as the compression ratio is constant, it is suitable to apply a compressor of fixed internal volume ratio with which the polytropic efficiency is maximum at the said compression ratio or a compressor of which the internal volume ratio is adjusted to give maximum polytropic efficiency at the said compression ratio. When the fixed internal volume ratio compressor is applied, a screw compressor is used of which the fixed internal volume ratio is the internal volume ratio in full load in the condition of the use.

Although an engine (with a clutch and controlled stepwise by change gear) or others can be used for the driving machine, an inverter motor of which the rotation speed is controlled by varying the frequency is suitable, for the stepless control of the gas flow rate is easy.

Figure 1B:
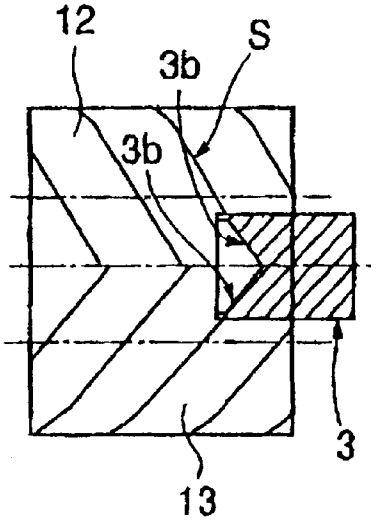
FIG. 1 shows when the internal volume ratio of the compressor used in the screw compressor equipment for accommodating low compression ratio and pressure variation according to the present invention is minimum, (A) is an axial sectional view, and (B) is a partial plan view showing the position of an internal volume ratio control valve relative to seal lines of tooth tip of rotors.

Reference numeral 1 is a screw compressor, 2 is a driving machine, 3 is an internal volume ratio control valve, 4 is a control valve drive, 9 is a bypass control valve, and 10 is a computing device.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1A:
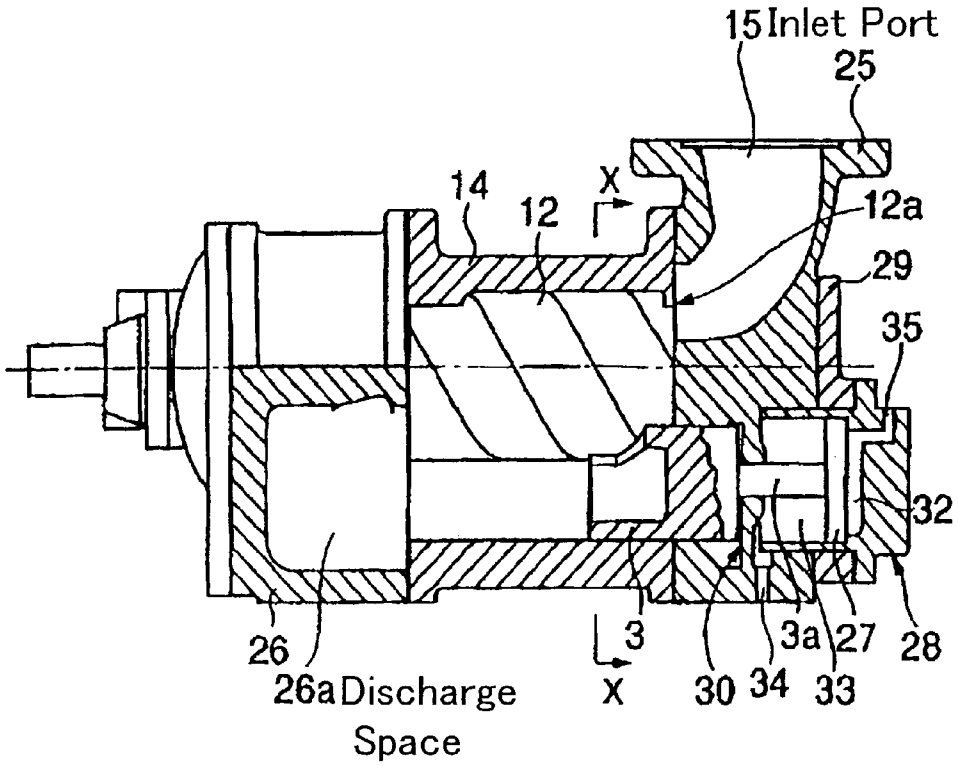
Figure 2B:
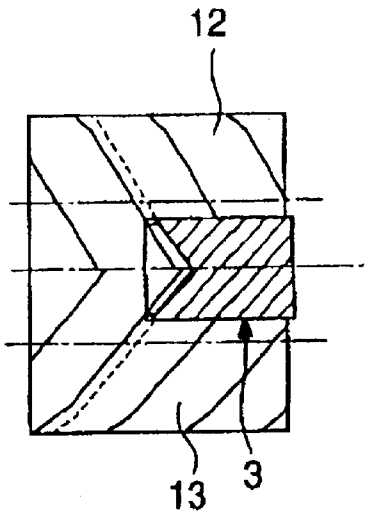
FIG. 2 shows when the internal volume ratio of the compressor used in the screw compressor equipment for accommodating low compression ratio and pressure variation according to the present invention is maximum, (A) is an axial sectional view, and (B) is a partial plan view showing the position of an internal volume ratio control valve relative to seal lines of tooth tip of rotors.
Figure 2A:
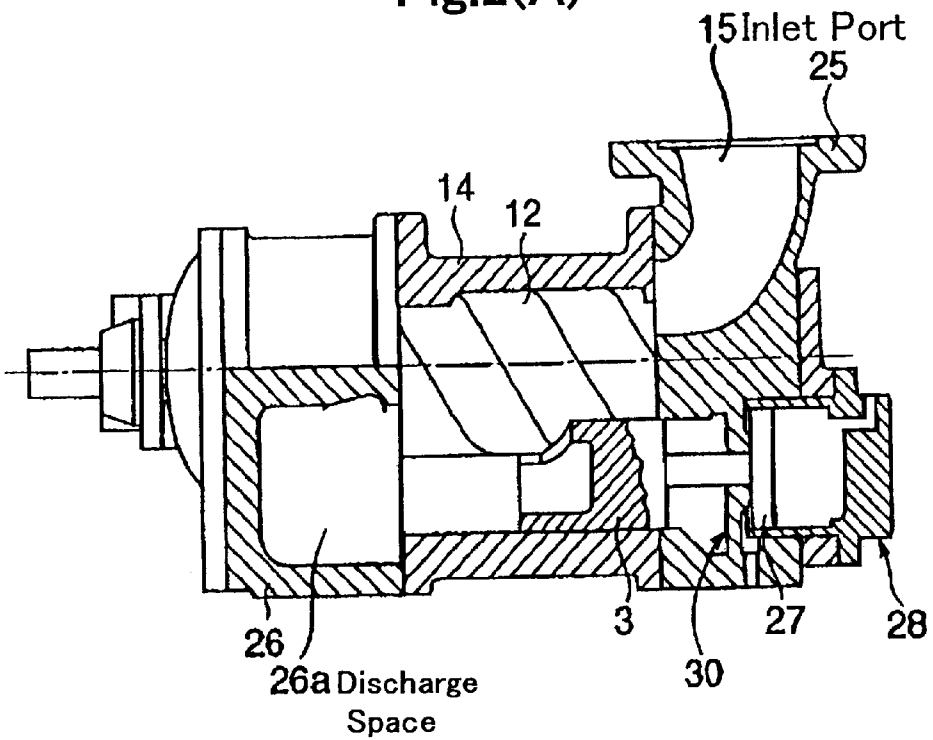
Figure 3A:
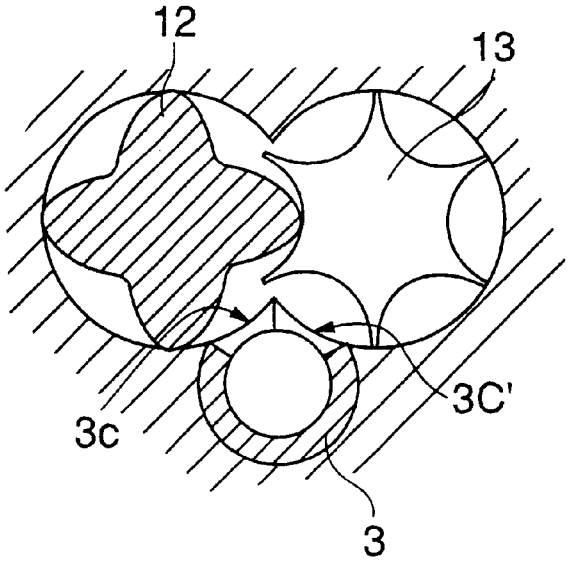
FIG. 3(A) is a cross sectional view along line X—X in FIG. 1.
Figure 3B:
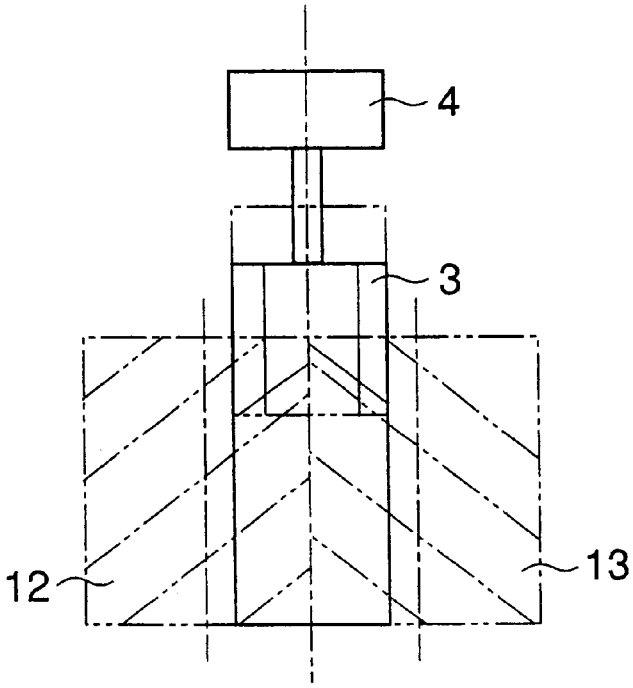
FIG. 3(B) is a partial plan view of an internal volume ratio control valve connected with a control drive.

Each of FIG. 1 and FIG. 2 shows the screw compressor used in a screw compressor equipment for accommodating low pressure ratio and pressure variation according to the present invention, (A) is a cross sectional view, and (B) is a partial plan view showing the position of an internal volume ratio control valve relative to seal lines of tooth tip of rotors. FIG. 3(A) is a transverse cross sectional view showing the state of an internal volume ratio control valve 3 straddling a male and female rotor 12 and 13, which is the cross sectional view along the line X—X in FIG. 1. FIG. 3(B) is a partial plan view of an internal volume ratio control valve 3 connected with a control drive 4, in which the seal lines of tooth tip and the beginning edge line of the internal volume ratio control valve are developed along the outer circumferences of rotors 12 and 13.

In FIG. 1, a male rotor 12 and a female rotor 13 are mounted in a rotor casing 14 parallel to each other to mesh with each other. An internal volume ratio control valve 3 is mounted straddling the male rotor 12 and female rotor 13. The mounted state of the internal volume ratio control valve 3 on the both rotors 12 and 13 is shown in FIG. 3 (A) and (B). In FIG. 3 (A), control faces 3*c*, 3*c*' form a part of the inner peripheral wall of the rotor casing 14 housing the rotors 12, 13, facing the perimeters of the rotors 12, 13 with minimal gaps. Letter mark S indicates a seal line of tooth tip at a certain position of rotation of the male rotor 12. To the suction side end of the internal volume control valve 3 is fixed a control shaft 3*a* to the other end of which is fixed a control piston 27. A suction side bearing housing 25 provided with a inlet port 15, and a discharge side bearing housing 26 is provided with a outlet port (not shown) communicating with a discharge space 26*a*.

A control cylinder 28 is fastened to a cover 29 fastened to the suction side bearing housing 25. The control piston 27 with a seal element (not shown) provided in a groove(not shown) on the periphery is inserted for slide in the control cylinder 28. The control shaft 3*a* passes through the wall 30 which divides the bore for inserting the internal volume control valve 3 and that for inserting the control cylinder 28 in the suction side bearing housing 25, the part of the control shaft 3*a* penetrating the wall 30 is sealed with a seal element (not shown).

Reference number 34, 35 are passages communicating with rooms formed in the left and right side of the control piston 27 respectively. Fluid such as oil is introduced into the room 32 or 33 to move the control piston 27 to the left or right by the difference of fluid pressure in the both rooms 32, 33, that is, to move the internal volume ratio control valve 3 to the left or right. The movement is controlled to move the control valve 3 to the position which is calculated so that the polytropic efficiency of the screw compressor becomes maximum.

Here, taking the position of rotation of the male rotor at which the maximum suction volume is enclosed as the reference position, an arbitrary rotation angle to the direction of compression from the reference position is denoted as θ m, and the internal volume ratio at θ m is denoted as Vim.

Gas is sucked into the groove space increasing with the rotation of the male rotor 12. The sucked gas is enclosed in the space of maximum groove volume confined by the meshing line of tooth faces, the seal lines of preceding and succeeding tooth tips, inner peripheral wall of the rotor casing, and the suction side end face 12*a* of the suction cover(suction side bearing housing 25) when the seal line of succeeding tooth tip coincides with the line of enclosing sucked gas at a rotation position of maximum groove volume.

As the rotor 12 rotates further, the lines S of tooth tip move toward the discharge side to permit the groove volume to be reduced resulting in the compression of the enclosed gas. The compression of the gas continues as far as the line of preceding tooth tip reaches the beginning edge line 3*b* of the cut-off of the internal volume ratio control valve 3.

As the rotor further rotates, as the line of the preceding tooth tip passes the beginning edge line 3*b* of the cut-off of the internal volume ratio control valve 3, the groove space communicates with the discharge space 26*a* and the compressed gas is discharged. Accordingly, if the internal volume ratio control valve 3 is positioned so that the beginning edge line 3*b* of the cut-off coincide with the line of preceding tooth tip when the angle of rotation position is θ m, the compressed gas in the enclosed groove is discharged with the volume ratio of Vim.

The possible range of movement is confined by the structure of the compressor. The larger the range of movement, the wider the range of internal volume ratio Vi controllable by the control valve 3.

In FIG. 1, the factor determining the range of the movement is the distance between the wall 30 and the suction side end face 12*a* of the rotor casing 13. The range of the movement of the internal volume ratio control valve 3 is confined by the said distance. Accordingly, the farther the wall 30 is located toward the right direction, the wider the range of Vi the compressor can respond to.

Figure 7:
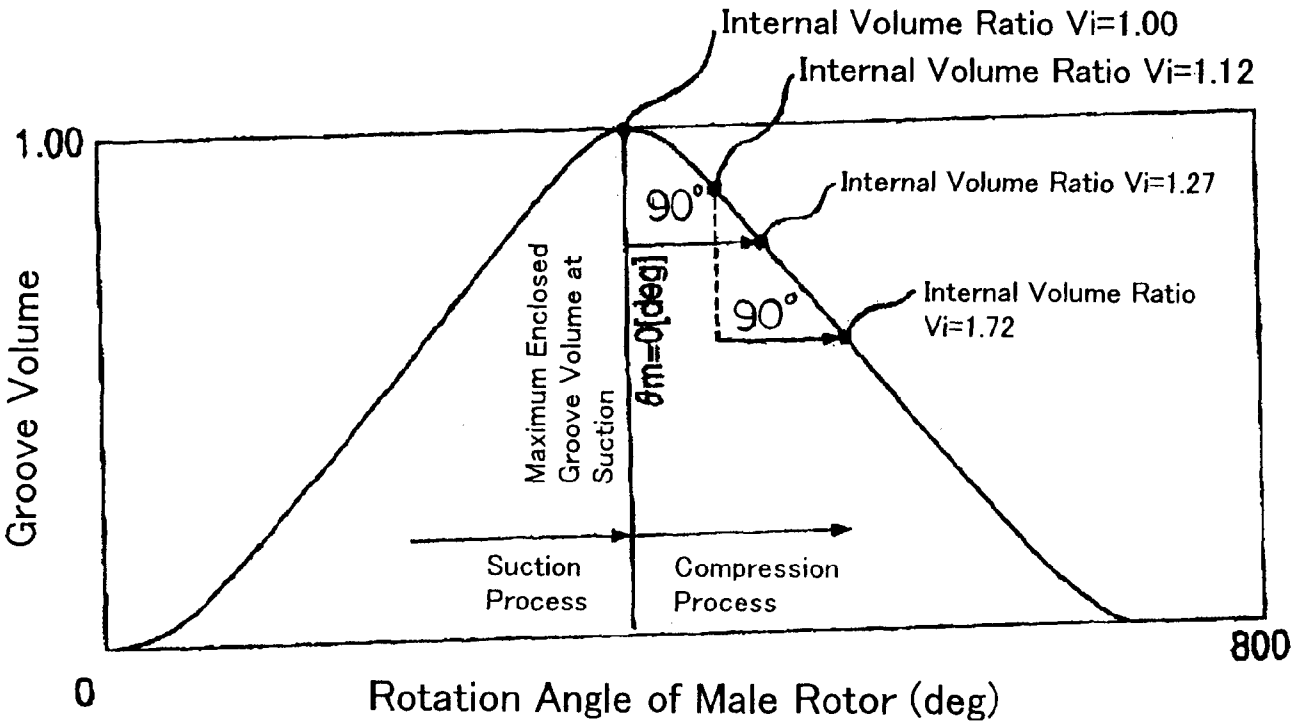
FIG. 7 is a graph showing an example of the change of groove volume in relation to the rotation angle of a male rotor.
Figure 8:
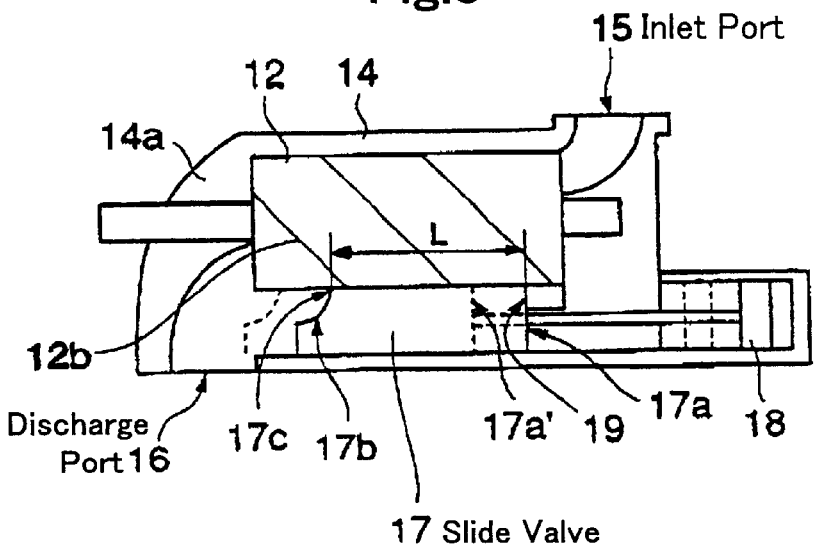
FIG. 8 is a diagrammatic sketch of a screw compressor for refrigerator showing the working of a slide valve for capacity controlling.
Figure 9A:
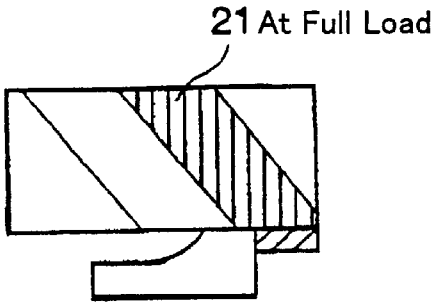
FIG. 9 is a schematic side view depicting the working of a slide valve when the designed-in internal volume ratio is reduced.
Figure 9B:
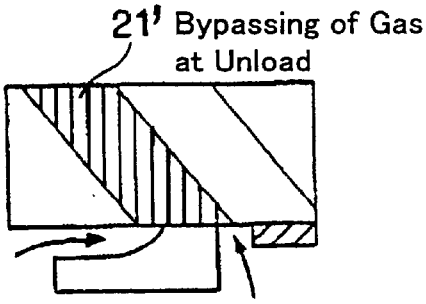

This will be explained with reference to FIG. 4 and FIG. 5. FIG. 4 shows the situation in which the internal volume ratio is determined by the position of the internal volume ratio control valve 3 in relation to the seal lines of tooth tip in the case the minimum internal volume ratio is 1.0 with the screw compressor having the groove volume characteristic shown in FIG. 7, and FIG. 5 shows in the case the minimum internal volume ratio is 1.12. In both figure, (A) shows when the internal volume ratio control valve is positioned so that Vi is minimum, and (B) shows when the internal volume ratio control valve is positioned so that Vi is maximum.

Figures 4A, 4B:
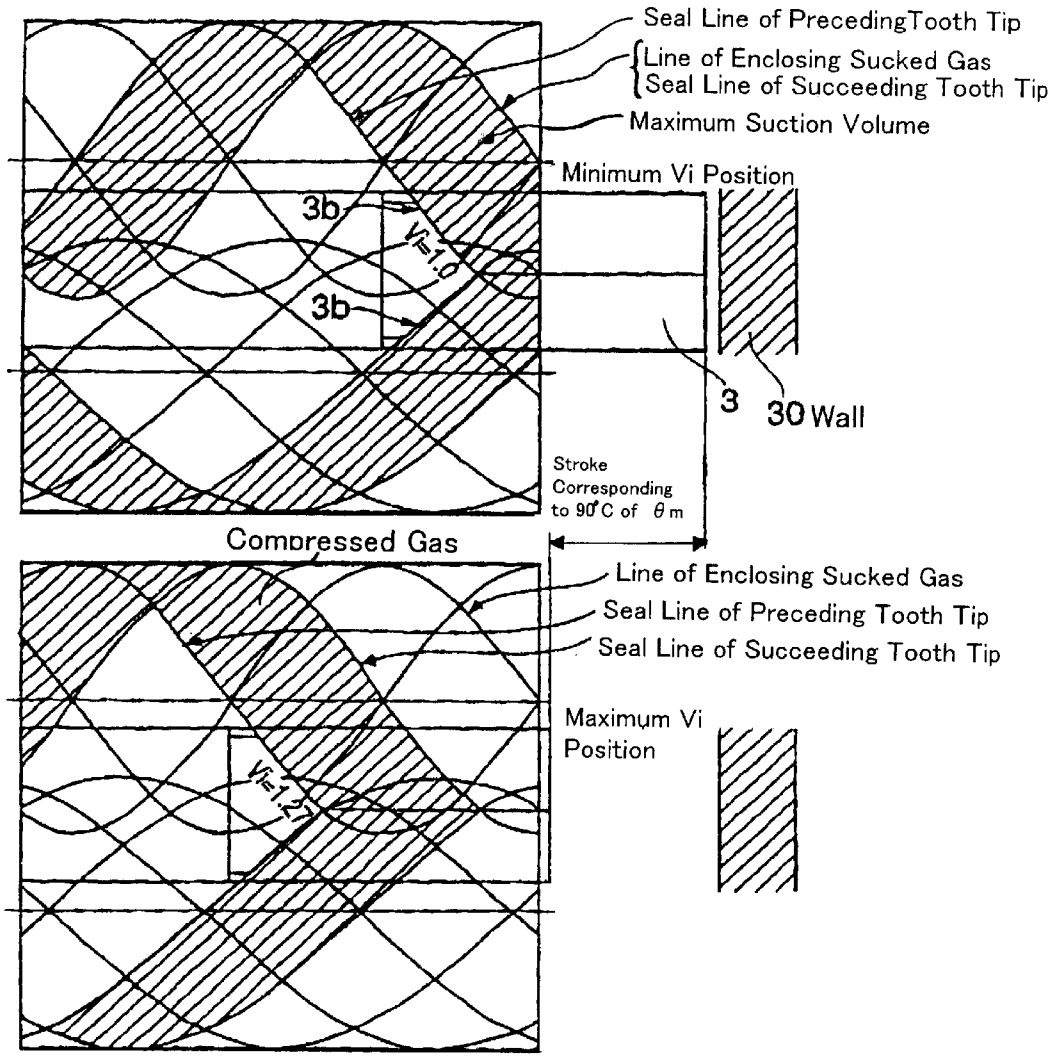
FIG. 4 is a diagram showing the condition the internal volume ratio is defined according to the position of an internal volume ratio control valve relative to seal lines of tooth tip when the minimum internal volume ratio is 1.0.
Figures 5A, 5B:
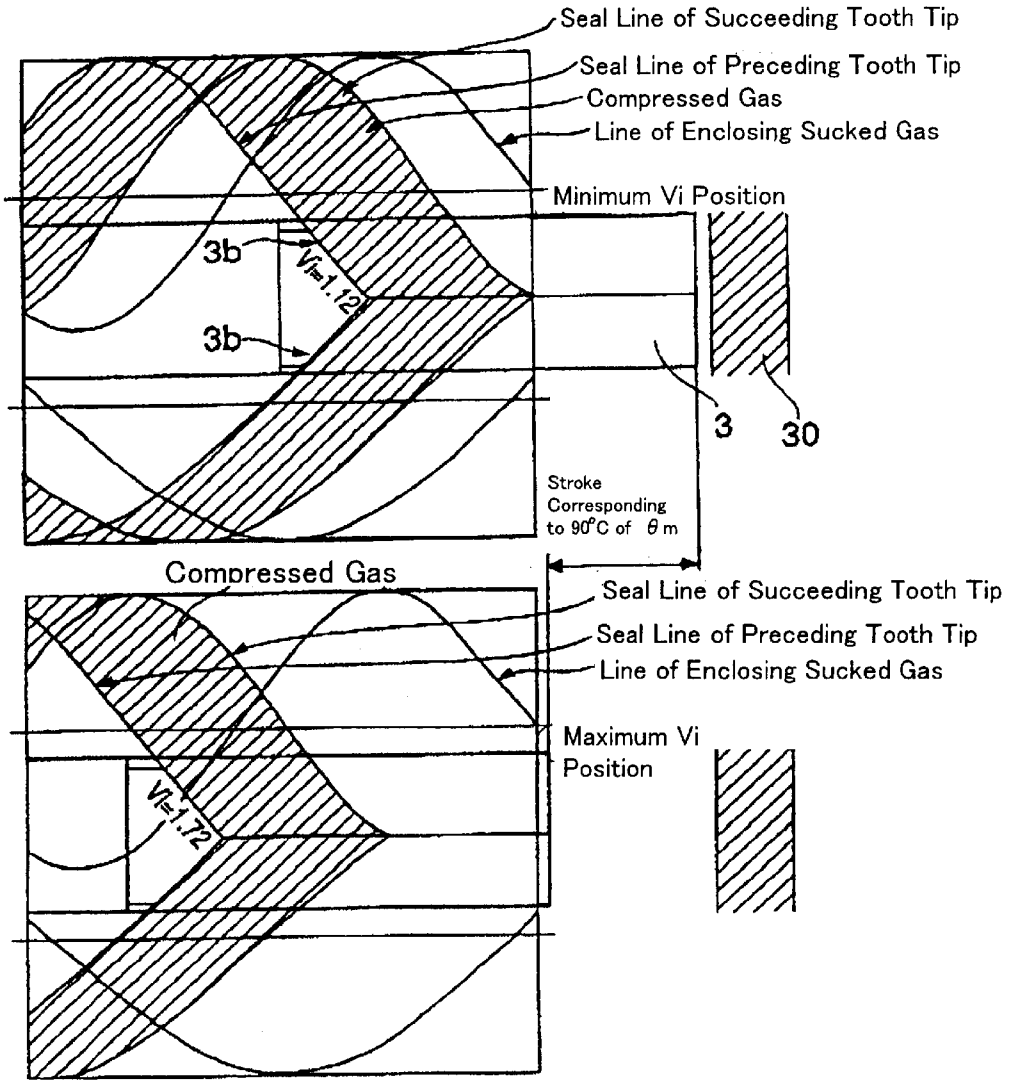
FIG. 5 is a diagram showing the condition the internal volume ratio is defined according to the position of an internal volume ratio control valve relative to seal lines of tooth tip when the minimum internal volume ratio is 1.12.

In FIG. 4, it is supposed that the internal volume ratio control valve 3 is movable by the length along the axes corresponding to the rotation angle θ m of the male rotor, that is, by the length the lines of tooth tip proceed toward the discharge side (to the left in FIG. 4) when the male rotor rotates by angle θ m. In FIG. 4(A), the movement of the internal volume ratio control valve 3 to the right direction is restricted by the wall 30 and the beginning edge line 3*b* of the cut-off of the control valve 3 coincides with the seal line of tooth tip of Vi=1.0. (Although actually the movement of the control valve 3 is confined by the restriction of the movement of the control piston 27 and not directly confined by the wall 30, the wall 30 is a factor for restricting the movement of the control valve 3, and so here the expression "restricted by the wall 30" is used.) The position of rotation of the male rotor 12 in this situation is defined as the reference position, i.e. θm=0°.

The beginning edge line 3*b* of the cut-off of the control valve 3 coincides with the seal line of tooth tip of Vi=1.27, as shown in FIG. 4(B), when the control valve is moved toward the discharge side by the length corresponding to θm=90°. The control range of Vi is 1.0~1.27, which is small.

When the length of movement of the control valve 3 corresponding to θm=150° can be secured by locating the wall 30 at more right side than the position shown in FIG. 1 and FIG. 4, by making the beginning edge line 3*b* of the cut-off of the control valve 3 coincide with the seal line of tooth tip of Vi=1.0 when the control valve 3 is restricted by the wall 30 at the reference position of θm=0°, the control valve 3 can be moved toward the discharging side by the distance corresponding to θm=150° from the reference position of θm=0°. Then, as shown in FIG. 7, Vi=1.72, and a control range of Vi of 1.0~1.72 is obtained, which is relatively large.

When a larger range of control of Vi is desired in the case the range of movement of the internal volume ratio control valve 3 is confined by the condition of design, the range of control of Vi can be expanded as follows. As mentioned above, when the range of movement of the control valve 3 is a distance corresponding to θm=90°, the range of control of Vi is as small as 1.0~1.27. By making the minimum internal volume ratio larger than 1.0 when the control valve 3 is restricted by the wall 30, a larger range of control of Vi can be obtained with the confined range of movement of 90° of the control valve 3.

For example, supposing θm=40° when the movement of the control valve 3 to the right direction is restricted by the wall 30, then Vi=1.06 is read with reference to FIG. 7. When the control valve 3 is moved toward the discharge side by the distance corresponding to θm=90°, then Vi is 1.54 corresponding to θm=40+90=130° with reference to FIG. 7. Thus, the range of control of Vi is expanded to 1.06~1.54. Further, if the θ m is 60° when the movement of the control valve 3 to the right direction is restricted by the wall 30, then Vi is 1.12 as shown in FIG. 7. When the control valve 3 is moved toward the discharge side by the distance corresponding to θm=90°, then Vi is 1.54 corresponding to θm=60+90=150° as shown in FIG. 7. Thus, the range of control of Vi is further expanded to 1.12~1.72.

If the minimum value of Vi is made larger than 1.0, there arises a drawback of larger starting torque of the compressor as a little compression is performed even when the compressor is started with Vi adjusted to the minimum, however, when the value of Vi is a level of 1.2 or lower, the torque for compressing gas is relatively small and practically acceptable. To permit the minimum Vi of larger than 1.0 is practical in the case the range of movement of the control valve 3 is confined due to design conditions.

Figure 6:
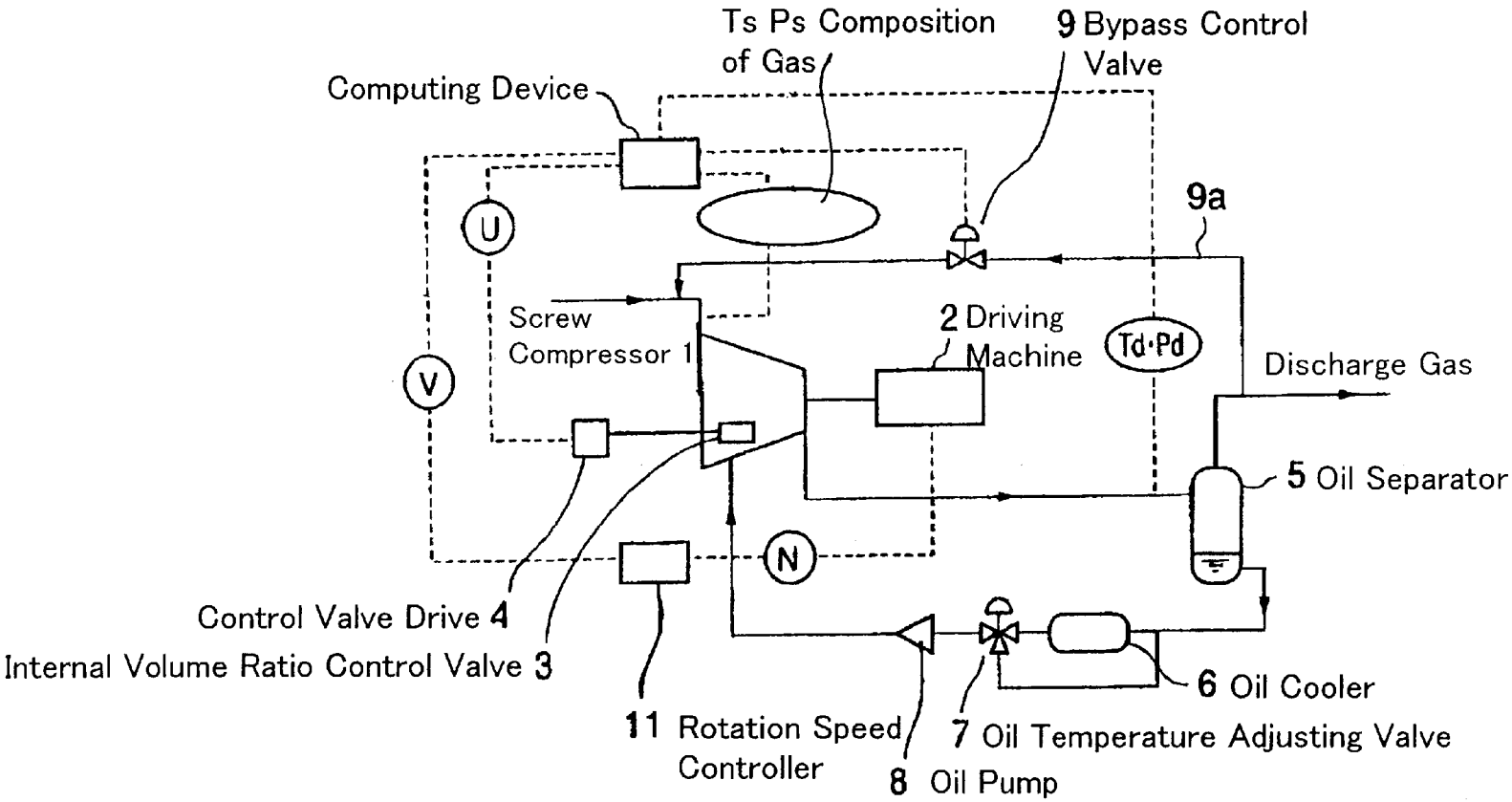
FIG. 6 is a block diagram of a screw compressor equipment for accommodating low compression ratio and pressure variation according to the present invention.

FIG.6 is a block diagram of a screw compressor equipment for accommodating low compression ratio and pressure variation according to the present invention. The figure is an embodiment when a oil cooled type screw compressor is used.

The equipment comprises a screw compressor 1, a driving machine 2, an internal volume ratio control valve 3 for varying the internal volume ratio of the screw compressor 1, and a control valve drive 4 for moving the internal volume ratio control valve 3 along the axes of rotors 12, 13 (FIG. 3(B)).

The gas sucked and compressed in the screw compressor 1 is sent to an oil separator 5 to separate the oil in the compressed gas, the compressed gas is sent to a succeeding equipment (not shown), and the separated oil accumulating at the bottom part of the oil separator 5 is circulated to the screw compressor 1 through an oil cooler 6 and an oil pump 8. The temperature of the oil to be circulated to the screw compressor 1 is adjusted by increasing or decreasing the oil flow bypassing the oil cooler 6 by the oil temperature adjusting valve 7. A bypass passage 9*a* having a bypass control valve 9 and connecting the discharge side with the suction side of the screw compressor 1 is provided. Reference number 10 is a computing device for determining the position of the internal volume ratio control valve 3 so that the polytropic efficiency of the screw compressor 1 is maximum, that is, for determining the position with which the pressure in the enclosed groove space just before it communicates with the discharge space 26*a* is the same as that in the discharge space 26*a*. The rotation speed of the driving machine 2 is controlled by a rotation speed controller 11.

In FIG. 6, letter mark $P_s$ indicates suction pressure, $T_s$ suction temperature, $P_d$ discharge pressure, $T_d$ discharge temperature, N rotation speed, and U and V are instructions computed by the computing device 10 to be executed by the control drive 4 and the rotation speed control valve 11 respectively.

The internal volume ratio with which the polytropic efficiency becomes maximum is calculated by the computing device 10 based on the measured $P_s$, $P_d$, $T_s$, $T_d$, N, and the kind of gas and cooling condition in compression process, etc., and also the computing device 10 determines the position of the internal volume ratio control valve 3 to realize the calculated internal volume ratio. The result of the computation is sent to the control valve drive 4 to move the internal volume ratio control valve 3 to the determined position.

To move the internal volume ration control valve 3, liquid pressure such as oil pressure or a device which converts the rotation of a step motor to a straight-line motion can be used. For detection of the position of the internal volume ratio control valve 3 can be used a rectilinear position detector or a device with which the position is detected by detecting the rotation angle of the step motor.

The gas flow rate of the screw compressor 1 is controlled by varying the rotation speed of the driving machine 2 of variable rotation speed. The lowest usable rotation speed of the screw compressor is predetermined because of mechanical constraints and for securing a certain level of efficiency. When a small gas flow rate smaller than that at the lowest usable rotation speed is required, the gas flow rate is decreased by bypassing the gas from the discharge side to the suction side by actuating the bypass control valve 9 provided on the bypass passage 9*a*.

To decrease the gas flow rate, the rotation speed is decreased by the medium of the rotation speed controller 11, but when the rotation speed reaches the lowest usable rotation speed, the bypass control valve 9 is actuated by the signal from the computing device 10 without decreasing the rotation speed. After the speed reached the lowest usable rotation speed, the computing device 10 calculate the adequate amount of opening of the bypass control valve 9 based on the suction and discharge pressure to control the bypass control valve 9.

In the case the suction and discharge pressure is constant, the screw compressor 1 can be of a fixed internal volume ratio. In such a use, by applying a screw compressor of fixed internal volume ratio, the compressor is mechanically and electrically more simplified and reduced in cost than applying a screw compressor having an internal volume ratio control valve.

As explained above, according to the present invention, the screw compressor can be used for the compression of low compression ratio without reduction in efficiency, and as the lower limit for the rotation of the compressor is determined and the gas flow rate is controlled by a method of bypassing the gas when the gas flow rate is very small, operation without reduction in efficiency and mechanical troubles resulting from very low rotation speed is possible.

What is claimed is:

1. A screw compressor equipment comprising;

a screw compressor driven by a driving machine of variable rotation speed, said compressor having a male and a female rotor;

a computing means for calculating a polytropic exponent according to the kind of gas to be compressed and the structure and operating conditions of the compressor; and a controller for moving and fixing an internal volume ratio control valve of the screw compressor to a position determined based on a calculated internal volume ratio;

wherein the internal volume ratio is controlled by moving the internal volume ratio control valve so that the polytropic efficiency of the screw compressor is always maximum, wherein said equipment is applied in a use for low compression ratio in the case of compressing gas of relatively high suction pressure to a constant discharge pressure, or in a use for low compression ratio or fluctuating compression ratio in the case of compressing gas of fluctuating suction pressure to a constant discharge pressure, wherein the internal volume ratio control valve straddles both the rotors has a control shaft by way of which the valve can be moved in a direction parallel to both the rotors and is provided with a cut in a discharge side end part thereof, and wherein the internal volume ratio is controlled to be 1.9 to 1.0 by controlling timing of communication of a tooth groove space with a discharge port by moving the control valve by way of said controller.

2. A screw compressor equipment according to claim 1, wherein the discharge side of the screw compressor is connected with the suction side of the same by the medium of a bypass control valve.

3. A screw compressor equipment according to claim 1, wherein the internal volume ratio control valve of the screw compressor is capable of being moved to positions with which the internal volume ratio varies from near 1.0 to a value corresponding to the pressure ratio of steady state operation.

4. In a screw compressor equipment comprising a screw compressor driven by a driving machine of variable rotation speed, a method of operating the equipment comprising;

calculating a polytropic exponent according to a kind of the gas to be compressed and the structure and operating conditions of the compressor;

controlling the positioning of an internal volume ratio control valve of the screw compressor based on a calculated internal volume ratio so that the polytropic efficiency of the screw compressor is always maximum;

controlling the flow rate of fluid through the screw compressor by controlling the rotation speed of the driving machine, wherein said equipment is applied in a use for low compression ratio in the case of compressing gas of relatively high suction pressure to a constant discharge pressure, or in a use for low compression ratio or fluctuating compression ratio in the case of compressing gas of fluctuating suction pressure to a constant discharge pressure, the internal volume ratio control valve straddling both a male and a female rotor, having a control shaft by way of which the valve can be moved in a direction parallel to both the rotors and being provided with a cut in the discharge side end part thereof, and the internal volume ratio is controlled to be 1.9 to 1.0 through controlling the timing of the communication of a tooth groove space with a discharge port by moving the control valve by way of a controller.

5. A method of operating the equipment according to claim 4, wherein the gas flow rate of the compressor when the rotation speed is equal or lower than the minimum usable rotation speed is controlled by controlling the bypass control valve of a bypass passage connecting the discharge side with the suction side of the compressor.

6. A method of operating the equipment according to claim 4, wherein after the driving machine is started by adjusting the position of the internal volume control valve so that the starting torque of the compressor is smaller than the torque the driving machine can develop at starting, the internal volume control valve is moved to the position with which the polytropic efficiency becomes maximum in operation.

7. A method of operating a screw compressor equipment, a compressor which compresses sucked fluid enclosed in a tooth groove space formed by meshing of a male rotor and a female rotor accommodated in a casing by a change of the volume of the space as the rotors rotate being driven by a variable rotation speed driving machine, wherein the equipment is applied in a use for low compression ratio in the case of compressing gas of relatively high suction pressure to a constant discharge pressure, or in a use for low compression ratio or fluctuating compression ratio in the case of compressing gas of fluctuating suction pressure to a constant discharge pressure, an internal volume ratio control valve straddling both the rotors and having a control shaft by way of which the valve can be moved in a direction parallel to both the rotors and being provided with a cut in a discharge side end part thereof, a computing device for calculating a polytropic exponent according to the kind of gas to be compressed and operating conditions of the compressor, and a controller for moving and fixing the internal volume ratio control valve to and at a position determined based on the internal volume ratio calculated by said computing device are provided, and the internal volume ratio is controlled to be 1.9 to 1.0 by controlling the timing of the communication of the tooth groove space with the discharge port by moving the control valve by way of said controller.

8. The method of operating the equipment according to claim 7, wherein a slide valve for controlling capacity is not provided, instead the internal volume ratio control valve is provided, and the control of the rate of flow is accomplished by controlling the rotation speed of the screw compressor.

9. The method of operating the equipment according to claim 7, wherein continuous operation under low rotation speed for accommodating low flow rates is evaded, instead the control of the rate of flow when the rate of flow is low is done by controlling the rate of the bypass flow of discharged gas bypassed from the discharge side to the suction side through a bypass control valve provided in the passage connecting the discharge side with the suction side.

10. The method of operating the screw compressor equipment according to claim 7, wherein the position of the internal volume ratio control valve is controlled to be constant so that the polytropic efficiency of the screw compressor is always maximum in the case of suction and discharge pressures being constant.

11. The method of operating the equipment according to claim 7, wherein the screw compressor is started with the internal volume ratio adjusted to a value near 1.0, and then said internal volume ratio control valve is moved to a position where the polytropic efficiency becomes maximum for succeeding operation.

* * * * *